US008839782B2

(12) United States Patent
Hess

(10) Patent No.: US 8,839,782 B2
(45) Date of Patent: Sep. 23, 2014

(54) WARMING CARRIER

(76) Inventor: Judy Hess, Milton, WV (US)

( * ) Notice: Subject to any disclaimer, the term of this patent is extended or adjusted under 35 U.S.C. 154(b) by 510 days.

(21) Appl. No.: 13/181,968

(22) Filed: Jul. 13, 2011

(65) Prior Publication Data

US 2012/0012627 A1 Jan. 19, 2012

Related U.S. Application Data

(60) Provisional application No. 61/364,171, filed on Jul. 14, 2010.

(51) Int. Cl.

| | |
|---|---|
| ***F24J 1/00*** | (2006.01) |
| ***A45C 15/00*** | (2006.01) |
| ***A45F 3/02*** | (2006.01) |
| ***A45C 11/20*** | (2006.01) |
| *A45C 13/26* | (2006.01) |

(52) U.S. Cl.

CPC . *A45F 3/02* (2013.01); *A45C 15/00* (2013.01); *F24J 1/00* (2013.01); *A45C 13/26* (2013.01); *A45C 11/20* (2013.01)

USPC ..... 126/263.02; 126/263.01

(58) Field of Classification Search

CPC ..... F24J 1/00

USPC ..... 126/263.01, 263.02

See application file for complete search history.

(56) References Cited

U.S. PATENT DOCUMENTS

| | | | | |
|---|---|---|---|---|
| 3,561,424 | A | 2/1971 | Failla | |
| 3,675,637 | A | 7/1972 | Trimble | |
| 4,753,085 | A | 6/1988 | Labrousse | |
| 4,823,769 | A | 4/1989 | Semaan | |
| 5,377,664 | A * | 1/1995 | Dodge | 126/204 |
| 5,388,565 | A | 2/1995 | Ou | |
| 5,580,625 | A * | 12/1996 | Capy et al. | 428/35.2 |
| 5,628,304 | A | 5/1997 | Freiman | |
| 5,738,082 | A * | 4/1998 | Page et al. | 126/263.01 |
| 5,916,470 | A | 6/1999 | Besser et al. | |
| 6,234,165 | B1 | 5/2001 | Creighton et al. | |
| 6,513,516 | B2 * | 2/2003 | Sabin et al. | 126/263.01 |
| 6,861,618 | B2 | 3/2005 | Binet et al. | |
| D582,789 | S * | 12/2008 | Blinderman et al. | D9/631 |
| 7,721,556 | B2 | 5/2010 | Guida | |
| 8,220,451 | B2 * | 7/2012 | Miwa et al. | 126/263.02 |

(Continued)

OTHER PUBLICATIONS

Dex Products, Inc., dexbaby grad 'n go bottle warmer, http://www.dexproducts.com/products_feeding_bwc.htm, website accessed Jul. 15, 2011.

(Continued)

*Primary Examiner* — Kenneth Rinehart

*Assistant Examiner* — Gajanan M Prabhu

(74) *Attorney, Agent, or Firm* — Dinsmore & Shohl LLP; Monika J. Hussell, Esq.

(57) ABSTRACT

Embodiments of the present invention relate generally to carriers that may simultaneously carry and warm receptacles of food products or other goods (e.g., baby wipes) and methods of the same. More particularly, embodiments relate generally to carriers that respectively comprise a body and a heating element. The body comprises a pouch that is configured to receive a receptacle containing a food product or other good and a heating element configured to perform an exothermic reaction to heat the same without the aid of an electric power source. The pouch comprises thermal insulation to enhance the heat-retention capabilities thereof.

12 Claims, 3 Drawing Sheets

(56) References Cited

U.S. PATENT DOCUMENTS

| | | | | |
|---|---|---|---|---|
| 2002/0121448 | A1* | 9/2002 | Richardson | 206/349 |
| 2006/0283205 | A1 | 12/2006 | Carriere | |
| 2007/0034202 | A1* | 2/2007 | Pumphrey et al. | 126/263.01 |
| 2007/0289938 | A1* | 12/2007 | Spooner | 215/387 |
| 2010/0126492 | A1 | 5/2010 | St. Etienne | |

OTHER PUBLICATIONS

Mom 4 Life, Baby Goga Baby Bottle and Baby Food Warmer, http://www.mom4life.com/baby-goga-baby-bottle-and-baby-food-warmer.html, website accessed Jul. 15, 2011.

Ricability, Consumer Reports, Portable and Travel Bottle Warmers, http://www.ricability.org.uk/consumer_reports/parenting/bottle_warmers_sterilisers/bottle_warmers/portable/, website accessed Jul. 15, 2011.

Travel With Tots, Click 'N' Go Bottle Warmer—Cherub Baby, http://www.travelwithtots.com.au/clickngobottlewarmerreview.html, website accessed Jul. 15, 2011.

Cherub Baby Australia, Travel Bottle Warmers, http://www.cherub-baby.com.au/bottle_warmers/travel_bottle_warmers, website accessed Jul. 15, 2011.

On the Fly Bottle Warmer, http://www.ontheflybottle.com/, website accessed Jul. 15, 2011.

Mommy and Me Giveaways, On The Fly Bottle Warmer Review and Giveaway, http://mommyandmegiveaways.com/?p=3472, website accessed Jul. 15, 2011.

* cited by examiner

WARMING CARRIER

CROSS-REFERENCE TO RELATED APPLICATIONS

The present application is filed under 35 U.S.C. §111(a) and claims the benefit of U.S. Provisional Application Ser. No. 61/364,171, filed Jul. 14, 2010.

BACKGROUND

Many people often take food or beverages ("food products") with them with they leave their homes to have available for later consumption. For example, parents of infants and young children frequently take food products, such as, but not limited to, jars of baby food and bottles of milk, from the house for later feedings. Many people, particularly children, prefer their food products warm and may refuse to consume them otherwise. Often times, however, electricity is not readily available or accessible when away from the home or a vehicle to warm a food product before consumption. This creates frustration for the consumer and, in particular, for both a parent and a child when a hungry, upset child refuses to consume a cold food product.

SUMMARY

Embodiments of the present invention relate generally to carriers for warming receptacles and their contents. More particularly, embodiments relate generally to carriers respectively comprising a body configured to receive and accommodate a receptacle and a heating element for heating the receptacle and contents contained therein without the need for an electric power source.

In accordance with one embodiment, a carrier comprises a body and a heating element. The body comprises a pouch, a fastener, and a handle. The pouch comprises an opening and a heating chamber accessible through the opening of the pouch. The fastener is configured to close the opening of the pouch. The heating chamber is defined by an interior layer of the pouch comprising thermal insulation and is configured to receive a receptacle and the heating element. The handle comprises a first strap and a second strap. The first strap and the second strap respectively comprise a first end that is secured to the pouch and a second end that is configured to fasten to the second end of the other of the first strap and the second strap. The heating element comprises an air-activated oxidation packet configured to perform an exothermic reaction without the aid of an electric power source and to insert through the opening of the pouch and into the heating chamber.

In accordance with another embodiment, a carrier comprises a body and a heating element. The body comprises a pouch and a handle. The pouch comprises an opening and a heating chamber accessible through the opening of the pouch. The heating chamber is defined by an interior layer of the pouch comprising thermal insulation and is configured to receive a receptacle and the heating element. The pouch comprises a degree of elasticity sufficient for the pouch to transition between a relaxed state and a stretched state for the pouch to accommodate one or more receptacles of various shapes or sizes beyond a shape and size of the pouch in the relaxed state. The heating element comprises an air-activated oxidation packet configured to perform an exothermic reaction without the aid of an electric power source and to insert through the opening of the pouch and into the heating chamber.

In accordance with yet another embodiment, a method of warming a receptacle and contents thereof comprises: providing a carrier comprising a pouch and a heating element, wherein the pouch comprises an interior layer comprising thermal insulation and defining a heating chamber of the pouch and, wherein the heating element comprises an air-activated oxidation packet configured to perform an exothermic reaction without the aid of an electric power source; activating the heating element by exposing the heating element to air; placing the activated heating element into the heating chamber; placing a receptacle containing contents in the heating chamber of the pouch with the activated heating element; closing the pouch with the receptacle and the activated heating element positioned within the heating chamber; and heating the receptacle and the contents with the heat produced by the activated heat element and retained in the heating chamber to increase the temperature of the receptacle and the contents.

BRIEF DESCRIPTION OF THE DRAWINGS

The following detailed description of specific embodiments can be best understood when read in conjunction with the following drawings, where like structure is indicated with like reference numerals and in which.

Figure 1A:
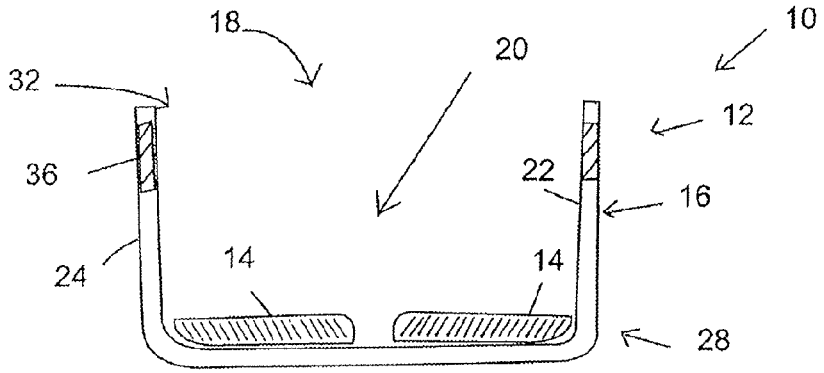
FIG. 1A is an illustration of a cross-sectional frontal view of a carrier in a relaxed state according to one embodiment of the present invention.

The embodiments set forth in the drawings are illustrative in nature and are not intended to be limiting of the embodiments defined by the claims. Moreover, individual aspects of the drawings and the embodiments will be more fully apparent and understood in view of the detailed description.

DETAILED DESCRIPTION

Embodiments of the present invention relate generally to carriers that may at least substantially enclose one or more receptacles of food products or other goods (e.g., baby wipes) (food products and other goods together referred to herein as "contents") to simultaneously carry and warm the same. Other embodiments relate generally to methods of warming receptacles and contents contained therein using a carrier, as described herein.

Figure 1B:
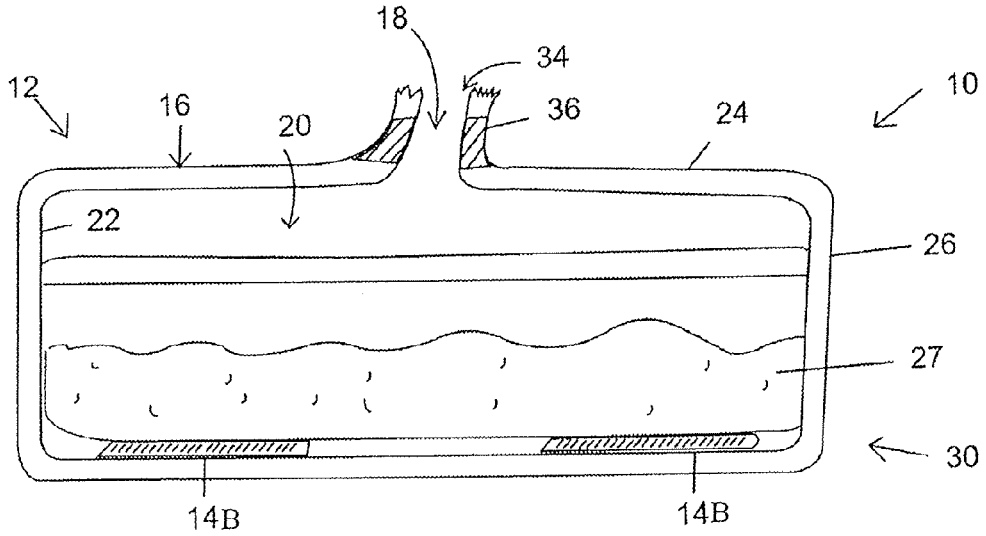
FIG. 1B is an illustration of another cross-sectional frontal view of the carrier of FIG. 1A, shown in a stretched state.

Referring initially to FIGS. 1A and 1B, the carrier 10 generally comprises a body 12 and a heating element 14. The body 12 comprises a pouch 16 that may be configured as a sack, a bag, or other enclosure that comprises an opening 18 and a heating chamber 20 accessible through the opening 18 of the pouch 16 and defined by a layer of material of the pouch 16. The pouch 16 may comprise a single layer of material or multiple layers of the same or different materials. For example, in the embodiment shown in FIGS. 1A and 1B, the pouch 16 comprises an interior layer 22 and an exterior layer 24. The interior layer 22 defines the heating chamber 20 of the pouch 16. The interior layer 22 comprises thermal insulation to enhance the retention of the heat produced by the heating element 14 when positioned within the heating chamber 20. The thermal insulation may comprise or consist of insulated batting, insulated foil lining, or other insulating materials. The exterior layer 24 of the pouch 16 generally covers an exterior surface of the interior layer 22 and may be configured of any one or more of a variety of materials so as to provide a decorative, aesthetic appeal and/or a functional purpose, such as, but not limited to, additional heat insulation, water-proofing, or ruggedness for greater durability. For example, but not by way of limitation, the exterior layer 24 may be configured of thermal insulation, cotton, polymer, cloth fabric, waterproof material, water resilient material, or any combination thereof. In one embodiment, the exterior layer 24 is configured of vinyl; while in another embodiment, the exterior layer 24 is configured of polytetrafluoroethylene; while in yet another embodiment, the exterior layer 24 is configured of a quilted cotton material.

Figure 2:
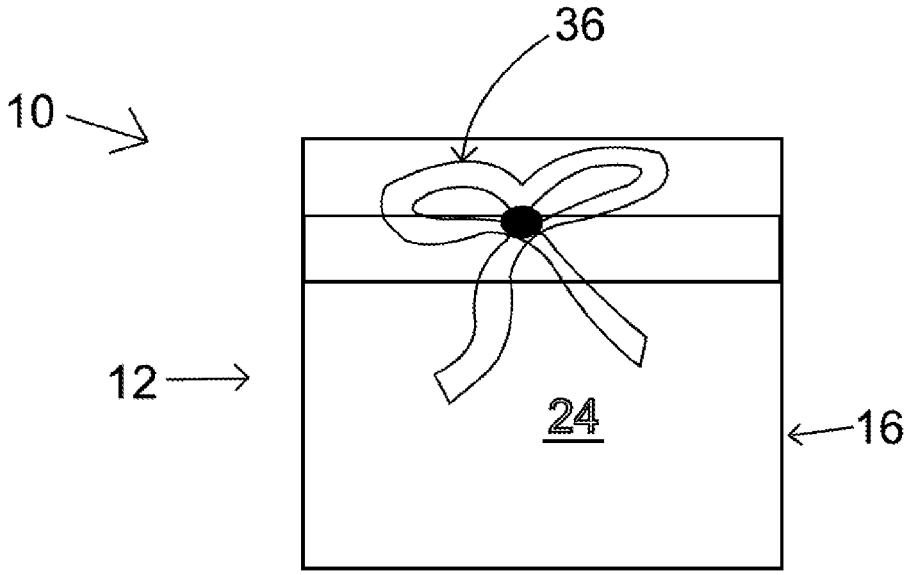
FIG. 2 is an illustration of a frontal view of a carrier according to another embodiment of the present invention.
Figure 3:
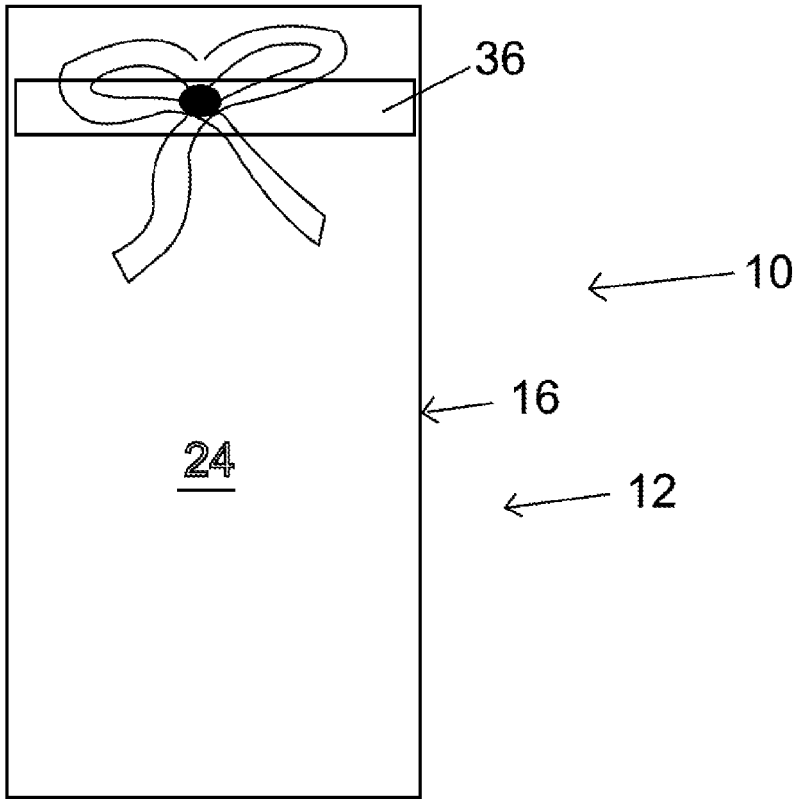
FIG. 3 is an illustration of a frontal view of a carrier according to another embodiment of the present invention.

The pouch 16 may comprise any shape or size so as to receive, accommodate, and substantially enclose one or more receptacles 26 of any variety of shapes or sizes. For example, but not by way of limitation, the pouch 16 may comprise an upright elongated, cylindrical shape to accommodate a beverage receptacle, such as a baby bottle, as shown in FIG. 3; a rectangular shape to accommodate a casserole dish, as shown in FIGS. 1A and 1B; or a square shape to accommodate a jar, as shown in FIG. 2. Also, by way of further example, and not of limitation, in one embodiment, a pouch comprising a rectangular shape may have a height of approximately 4½ inches, a depth of approximately 3½ inches, and a width of approximately 5 inches. In said embodiment, a drawstring having a length of approximately 18¼ inches and a width of approximately 3¼ inches may be used to close the opening 18 of the pouch, as described in greater detail below. Whereas, in another embodiment, a pouch comprising a cylindrical shape may have a diameter of approximately 5½ inches and a height of approximately 11 inches.

Further, as shown in FIGS. 1A and 1B, the pouch 16 may comprise a degree of elasticity sufficient for the pouch 16 to transition between a relaxed state 28 and a stretched state 30. Thereby, the pouch 16 may accommodate one or more receptacles 26 of various shapes or sizes beyond a shape and size of the pouch 16 in the relaxed state 28. In one embodiment, the pouch 16 is configured of or comprises an elastomer or a stretch fabric, including two-way stretch fabrics and four-way stretch fabrics, such as, but not limited to, spandex. In another embodiment, an elastomer is integrated into the thermal insulation of the interior layer 22 of the pouch 16 so that the thermal insulation comprises the degree of elasticity. For example, in one embodiment, the thermal insulation comprises insulated batting comprising the degree of elasticity. In another embodiment both the interior layer 22 of the pouch 16 and the exterior layer 24 of the pouch 16 comprise a degree of elasticity sufficient to enable the pouch 16 to perform as described. The present inventor further contemplates that the degrees of elasticity of the interior layer 22 and the exterior layer 24 may be the same, or substantially the same, or quite different, dependent upon the materials of which they are configured or that they comprise and the elastomers or stretch fabrics incorporated respectively therein.

In another embodiment, the pouch 16 also may comprise one or more pleats integrated into the interior layer 22 or both the interior layer 22 and the exterior layer 24. The pleats may be cut, released, or otherwise disengaged so as to allow excess material of the interior layer 22, the exterior layer 24, or both 22, 24, that is folded into the pleats. Thereby, the shape and/or size of the pouch 16, whether just the interior layer 22 or both the interior layer 22 and the exterior layer 24, may extend, or lengthen, to enable the pouch 16 to receive and accommodate one or more receptacles 26 of a shape or size larger than that of the pouch 16 prior to the release of the pleats. The present inventor further contemplates that the pleats may be re-stitched or re-engaged in place, or added in the event the pleats previously were not present, so as to reduce the size of the pouch 16, whether just the interior layer 22 or both the interior layer and the exterior layer 24.

The pouch 16 generally is configured such that the opening 18 may repeatedly transition between an open state 32 and a substantially closed state 34, as shown in FIGS. 1A and 1B. When the opening 18 is positioned in the open state 32, the pouch 16 permits the insertion of one or more receptacles 26 and one or more heating elements 14 into the heating chamber 20 of the pouch 16. Following the insertion of the receptacles 26 and heating elements 14, the opening 18 of the pouch 16 may be transitioned to the closed state 34 to enhance the heat-retention capability of the pouch 16 and the heating of the receptacles 26 and their contents 27. Generally, the positioning of the opening 18 in the closed state 34 does not close the opening 18 in its entirety and permits a slight amount of air flow through the opening 18 and within the heating chamber 20. It is the belief of the present inventor that the permission of slight air flow when the opening 18 is in the closed state 34 may enhance the heating of a receptacle 26 and its contents 27 placed in the heating chamber 20 by facilitating movement of the heat produced by the heating element 14 to substantially throughout the heating chamber 20 and substantially about the entirety of the receptacle 26.

Figure 4:
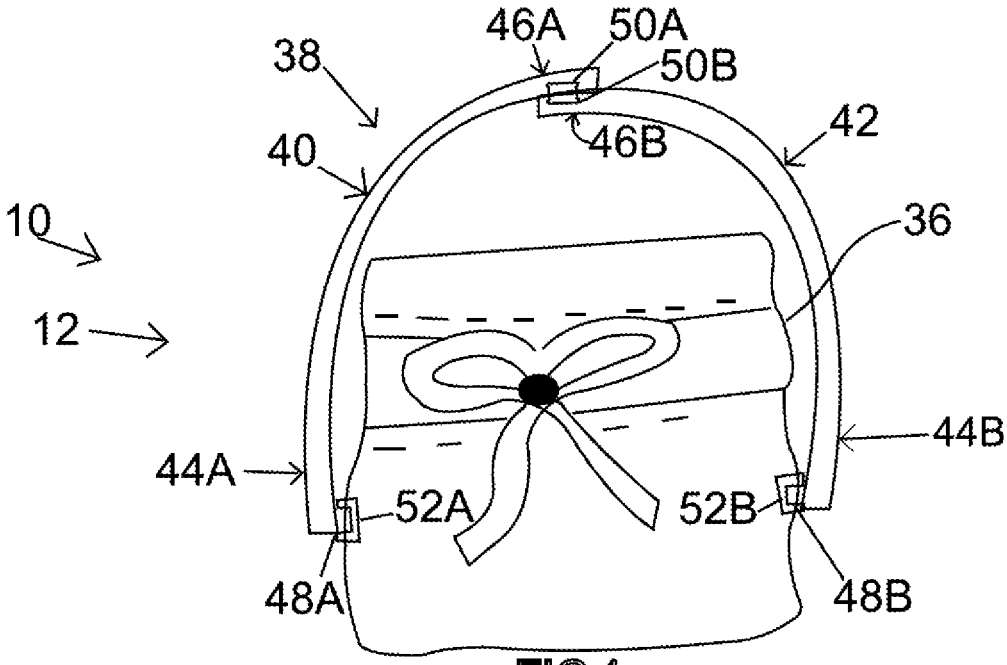
FIG. 4 is an illustration of a frontal view of a carrier comprising a handle according to another embodiment of the present invention.

To further enhance the heat-retention capability of the pouch 16, the body 12 of the carrier 10 also may comprise one or more fasteners operable to releasably secure the opening 18 of the pouch 16 in the closed state 34. For example, but not by way of limitation, the fasteners may include a drawstring 36, as shown in FIGS. 2, 3, and 4, an elastic band, two or more ties, series of hooks and loops, complementary snaps, a zipper, a button and button hole, complementary hooks, and/or one or more pairs of other complementary fasteners. When a user of the carrier 10 desires to access the interior of a closed pouch, the user may simply disengage the fastener and transition the opening 18 to the open state 32.

Further, the body 12 of the carrier 10 also may comprise a handle 38. The handle 38 may comprise a relatively short length for hand-carrying or a longer length for shoulder-carrying or back carrying. The present inventor contemplates that the length of the handle 38 may be adjustable or that the handle 38 may be replaceable or interchangeable with other-configured handles. In one embodiment, the handle 38 comprises two ends each secured to the pouch 16 to facilitate the carrying of the carrier 10. In another embodiment, shown in FIG. 3, the handle 38 comprises a first strap 40 and a second strap 42. The first strap 40 and the second strap 42 respectively comprise a first end 44A, 44B that is secured to the pouch 16 and a second end 46A or 46B that is configured to fasten to the second end 46A or 46B of the other of the first strap 40 and the second strap 42, as shown in FIG. 3.

Figure 5A:
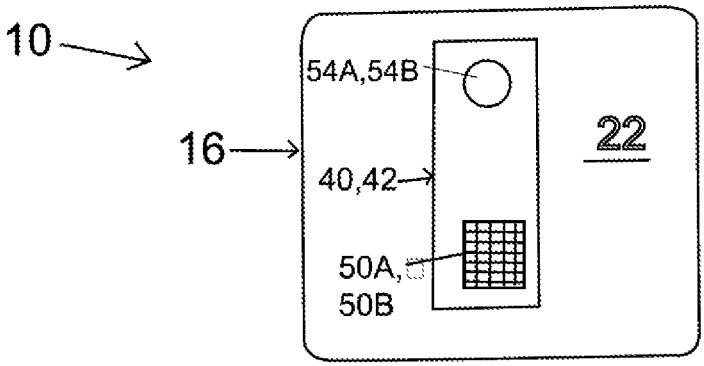
FIG. 5A is an illustration of a cross-sectional view of a carrier according to another embodiment of the present invention in which a strap is secured to the interior of the carrier.
Figure 5B:
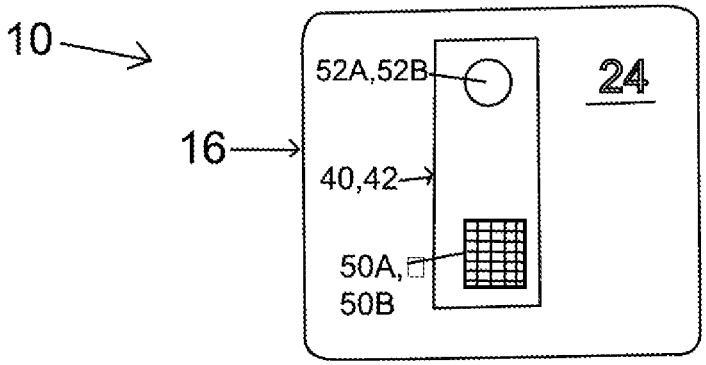
FIG. 5B is an illustration of a view of a carrier according to another embodiment of the present invention in which a strap is secured to the exterior of the carrier.

The handle 38 or straps 40, 42 may be permanently secured to any desirable area of either the interior layer 22 or the exterior layer 24 of the pouch 16 by stitching or otherwise or may be releasably secured thereto by one or more of any of the aforementioned releasable fasteners. Thereby, the handle 38 or straps 40, 42 are accessible from the pouch 16 so that the carrier 10 may be carried by hand from the handles or straps or may be tied, hung, or otherwise applied to another object, such as, but not limited to, a stroller, a wheelchair, a purse, or a backpack. In the embodiments shown in FIGS. 4 and 5B, each strap 40, 42 comprises a snap 48A, 48B at or near the respective first end 44A, 44B and a complementary series of hooks and loops 50A, 50B at or near the respective second end 46A, 46B, while the exterior layer 24 of the pouch 16 comprises snaps 52A, 52B complementary to the snaps 48A, 48B of the straps 40, 42. Thereby, the respective first ends 44A, 44B of the two straps 40, 42 may secure at or near opposite sides of the pouch 16 via fasteners and the respective second ends 46A, 46B of the straps 40, 42 may engage one another via their complementary fasteners to define a handle 38 for the carrier 10. In the embodiment shown in FIG. 5A, the straps 40, 42 are secured to the interior layer 22 of the pouch 16 so that, when the straps 40, 42 are not in use, they may disengage from each other by their releasable fasteners and turned downward so that they are positioned within the heating chamber 20 inside the pouch 16. The handle 38 and straps 40, 42 also may be disengaged and removed from the pouch 16 altogether.

The heating element 14 comprises an air-activated oxidation packet 14B that is configured to perform an exothermic reaction without the aid of an electric power source. Because the heating element 14 is portable and does not require any electricity for activation or operation, they facilitate the transportability of the carrier 10 and its ability to heat food products or other goods without the need for an electrical outlet and electricity. The heating element 14 generally may be activated to perform the exothermic reaction simply by being removed from a package and exposed to air. Once activated, the heating element 14 generally is configured to produce a sustained, substantially temperature-consistent heat over a number of hours, e.g. six to ten hours. Further, the heating elements 14 are environmentally friendly in that they generally are disposable and biodegradable and may be easily discarded once they are no longer in use The heat produced by the heating element 14 generally is sufficient to increase the temperature of food products held in receptacles 26 placed in the carrier 10 to what is generally a desirable, comfortable consumption temperature. For example, but not by way of limitation, the placement of a small jar (from about 3.0 ounces to about 5.0 ounces) of baby food at room temperature into a closed pouch 16 with two heating elements 14 for three hours will warm the food in the jar to what may be a desirable temperature from about 100 degrees to about 140 degrees, which may require a cooling period before consumption. The present inventor contemplates that the temperature of the warmed food products may vary according to a number of factors, including, but not limited to, the size of the receptacle 26 inserted into the pouch 16, the type, amount, and consistency of the food product(s) present within the receptacle 26, the number and size of the heating elements 14 used to warm the food product(s), and the length of time the receptacle 26 is held in the pouch 16 with the heat producing heating elements 14. For example, but not by way of limitation, a 4.5 ounce glass jar of diced carrots warmed in a pouch 16 by two small heating elements for about three hours may have a temperature of about 130 degrees; a 4.0 ounce glass jar of chicken noodle warmed in a pouch 16 by two small heating elements for about three hours may have a temperature from about 110 degrees to about 112 degrees; and an 8.0 ounce receptacle 26 containing cold milk or cold formula warmed in a pouch 16 by two large heating elements 14 for about three hours may have a temperature of about 108 degrees. The configuration of the pouch 16 with the thermal insulation and the generation of the heat by the heating elements substantially maintain the food products at what may be a generally desirable consumption temperature. The heating elements 14 may be configured in any desirable shape or size and may be of any commercially available variety operable to perform as described herein.

Additional embodiments relate generally to methods of warming food products or other goods. In one such embodiment, a method comprises: providing a carrier comprising a pouch and at least one heating element, wherein the pouch comprises an interior layer configured substantially of insulated batting and defining a heating chamber of the pouch; activating the heating element and placing the activated heating element in the heating chamber of the pouch, wherein the activated heating element produces heat; placing a receptacle containing a food product in the interior chamber of the pouch with the activated warming packet, wherein the food product or other good initially has a temperature lower than the temperature of the heat produced by the activated heating element; substantially closing the pouch so that the heating chamber of the pouch, the receptacle, and the activated heating element are substantially enclosed within the pouch; and allowing the heat produced by the activated heating element to increase the temperature of the food product or good.

In another embodiment, a method of warming a receptacle and contents thereof comprises: providing a carrier comprising a pouch and a heating element, wherein the pouch comprises an interior layer comprising thermal insulation and defining a heating chamber of the pouch and, wherein the heating element comprises an air-activated oxidation packet configured to perform an exothermic reaction without the aid of an electric power source; activating the heating element by exposing the heating element to air; placing the activated heating element into the heating chamber; placing a receptacle containing contents in the heating chamber of the pouch with the activated heating element; closing the pouch with the receptacle and the activated heating element positioned within the heating chamber; and heating the receptacle and the contents with the heat produced by the activated heat element and retained in the heating chamber to increase the temperature of the receptacle and the contents.

Further, by way of example and not of limitation, the present inventor contemplates that embodiments of the present invention may be used as follows: provide a carrier comprising a pouch and at least one heating element, wherein the pouch comprises an interior layer configured substantially of insulated batting and defining a heating chamber of the pouch; activate two heating elements and place them in the heating chamber of the pouch; close the pouch to retain the heat produced by the heating elements; after waiting about twenty minutes, open the pouch and place a jar or plastic receptacle containing baby food into the pouch such that one of the heating elements is underneath the jar or receptacle and one of the heating elements is alongside of the jar or receptacle; close the pouch and tie the pouch shut with drawstrings or ties thereof; allow the baby food to warm for about three hours, at which time, the baby food will be warm therethrough; remove the jar or receptacle from the pouch; after checking the temperature of the baby food, feed an infant the warmed baby food; place the receptacle containing any remaining baby food back into the pouch to keep the baby food warm for an additional length of time to a subsequent feeding.

While repeated reference is made herein to the warming of a cool or room temperature food product or goods, the present inventor contemplates that the carrier also is operable to maintain, or substantially maintain, a temperature of a food product or good substantially the same as or higher than that of the heat produced by the heating elements present in the pouch with the food product or goods. Thereby, an already warm or hot food product or good may be maintained at, or substantially maintained at, a temperature of the heat produced by the heating elements.

It is noted that recitations herein of a component of an embodiment being "operable" or "configured" in a particular way or to embody a particular property, or function in a particular manner, are structural recitations as opposed to recitations of intended use. More specifically, the references herein to the manner in which a component is "operable" or "configured" denotes an existing physical condition of the component and, as such, is to be taken as a definite recitation of the structural characteristics of the component.

It is noted that terms like "generally" and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "approximately," and "about" are utilized herein to represent the inherent degree of uncertainty that may be attributed to any quantitative comparison, value, measurement, or other representation. The terms "substantially," "approximately," and "about" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments may be identified herein as preferred or particularly advantageous, it is contemplated that the embodiments of the present invention are not necessarily limited to such aspects.

What is claimed is:

1. A method of warming a receptacle and contents thereof, the method comprising:

providing a carrier comprising a pouch, a handle, and a heating element, wherein the pouch comprises an interior layer comprising thermal insulation and defining a heating chamber of the pouch and, wherein the handle is secured to the interior layer of the pouch and accessible through an opening of the pouch and the heating element comprises an air-activated oxidation packet configured to perform an exothermic reaction without the aid of an electric power source;

activating the heating element by exposing the heating element to air;

placing the activated heating element into the heating chamber;

placing a receptacle containing contents in the heating chamber of the pouch with the activated heating element and in direct contact with the activated heating element;

transitioning the opening of the pouch toward a closed state, yet permitting air flow through the opening of the pouch so as to facilitate a movement of heat generated by the activated heating element within the heating chamber; and heating the receptacle and the contents with the heat produced by the activated heat element and retained in the heating chamber to increase the temperature of the receptacle and the contents.

2. A carrier comprising a body and a heating element, wherein:

the body comprises a pouch, a fastener, and a handle;

the pouch comprises an opening, a heating chamber accessible through the opening of the pouch, the fastener is configured to transition the opening of the pouch between an open state and a closed state;

the heating chamber is defined by the interior layer of the pouch comprising thermal insulation and is configured to receive a receptacle and the heating element;

the handle comprises a first strap and a second strap;

the first strap and the second strap respectively comprise a first end that is secured to the interior layer of the pouch and a second end that is configured to fasten to the second end of the other of the first strap and the second strap; and the heating element comprises an air-activated oxidation packet configured to perform an exothermic reaction without the aid of an electric power source and to insert through the opening of the pouch and into the heating chamber, wherein the pouch is configured to permit air flow through the opening of the pouch in the closed state so as to facilitate a movement of heat generated by the heating element when activated and received by the heating chamber.

3. The carrier of claim 2, wherein the pouch is configured such that the opening of the pouch in the closed state restricts air flow out of the pouch.

4. The carrier of claim 2, wherein the pouch comprises one of a rectangular shape and a square shape and is configured to permit air flow and a movement of heat within the heating chamber and about a cylindrically shaped receptacle received by the heating chamber, the heat generated by an activated heating element received by the heating chamber.

5. The carrier of claim 2, wherein the pouch comprises a cylindrical shape and is configured to permit air flow and a movement of heat within the heating chamber and about any one of a rectangular shaped receptacle, a square shaped receptacle, and a cylindrically shaped receptacle having a diameter smaller than that of the cylindrically shaped pouch that is received by the heating chamber, the heat generated by an activated heating element received by the heating chamber.

6. The carrier of claim 2, wherein the fastener comprises a drawstring applied to an exterior layer of the pouch such that a pulling of the drawstring transitions the opening of the pouch to a closed state.

7. The carrier of claim 2, wherein the pouch further comprises an exterior layer covering the interior layer and configured of one or more of thermal insulation, cloth fabric, waterproof material, and water resistant material.

8. The carrier of claim 7, wherein the exterior layer is configured of vinyl or polytetrafluoroethylene.

9. The carrier of claim 7, wherein the exterior layer is configured of a quilted cotton material.

10. The carrier of claim 2, wherein the thermal insulation comprises insulated batting or insulated foil lining.

11. A carrier comprising a body and a heating element, wherein:

the body comprises a pouch and a handle;

the pouch comprises an opening and a heating chamber accessible through the opening of the pouch;

the heating chamber is defined by an interior layer of the pouch comprising thermal insulation, accommodates the heating element, and is configured to receive a receptacle such that the receptacle is in direct contact with the heating element when received by the heating chamber;

the handle is secured to the interior layer of the pouch and accessible through the opening of the pouch; and the heating element comprises an air-activated oxidation packet positioned and placed loosely within the heating chamber and configured to perform an exothermic reaction without the aid of an electric power source, wherein the pouch is configured to permit air flow through the opening of the pouch in the closed state so as to facilitate a movement of heat generated by the heating element when activated and received by the heating chamber, and wherein the body of the carrier further comprises a fastener configured to transition the opening of the pouch between an open state and a closed state.

12. The carrier of claim 11, wherein the fastener comprises a drawstring applied to an exterior layer of the pouch such that a pulling of the drawstring transitions the opening of the pouch to a closed state.

* * * * *